United States Patent [19]

Ippolito et al.

[11] 4,342,247

[45] Aug. 3, 1982

[54] PRODUCTION OF DETUNING EFFECTS IN AN ELECTRONIC MUSICAL INSTRUMENT

[75] Inventors: Anthony C. Ippolito, DeKalb; William R. Hoskinson, Elburn, both of Ill.

[73] Assignee: The Wurlitzer Company, DeKalb, Ill.

[21] Appl. No.: 182,121

[22] Filed: Aug. 28, 1980

[51] Int. Cl.[3] ..... G10H 1/02

[52] U.S. Cl. ..... 84/1.24; 84/1.25; 84/DIG. 4

[58] Field of Search ..... 84/1.25, 1.24, DIG. 4, 84/DIG. 19

[56] References Cited

U.S. PATENT DOCUMENTS

| | | | |
|---|---|---|---|
| 3,828,109 | 8/1974 | Morez | 84/DIG. 4 |
| 4,186,637 | 2/1980 | Swain et al. | 84/1.25 X |
| 4,189,972 | 2/1980 | Yamada et al. | 84/1.25 |
| 4,196,651 | 4/1980 | Ippolito et al. | 84/1.01 |
| 4,215,616 | 8/1980 | Gross | 84/1.24 |
| 4,242,935 | 1/1981 | Peterson et al. | 84/DIG. 4 |
| 4,262,575 | 4/1981 | Bean | 84/DIG. 4 |

FOREIGN PATENT DOCUMENTS

| | | | |
|---|---|---|---|
| 249391 | 8/1962 | Australia | 84/DIG. 19 |

*Primary Examiner*—J. V. Truhe
*Assistant Examiner*—Forester W. Isen
*Attorney, Agent, or Firm*—Trexler, Bushnell & Wolters, Ltd.

[57] ABSTRACT

A detuning control circuit is provided for producing a pitch variation effect in an electronic musical instrument. The instrument includes at least one integrated circuit tone generator chip having at least one tone generator and a detuning circuit responsive to a predetermined detuning control signal for detuning the signals produced by the tone generator. The detuning control circuit comprises a detuning control signalling circuit for producing a predetermined detuning control signal and for selectively applying the predetermined detuning control signal to the detuning circuit of the tone generator chip so as to produce a predetermined pitch variation effect.

10 Claims, 8 Drawing Figures

PRODUCTION OF DETUNING EFFECTS IN AN ELECTRONIC MUSICAL INSTRUMENT

BACKGROUND OF THE INVENTION

The present invention is directed generally to electronic musical instruments, and more particularly to the production of pitch variation effects, such as celeste effects and vibrato effects, by controlled detuning of the tone generating circuits of the instrument.

Electronic musical instruments utilizing digital circuitry and digital techniques to produce musical sounds are generally well known in the art. Among the properties of music reproduced by such instruments are acoustically pleasing effects resulting from variations in the frequency of a tone about a given nominal frequency, or the playing of a tone detuned slightly in frequency with respect to another simultaneously sounded tone. In the former instance, the name "vibrato" is normally applied to the periodic frequency modulation of the pitch of a musical tone during the playing thereof. In the latter case, when two tones of nominally the same fundamental frequency are played in unison, a slight detuning or variation of the pitch of one of these tones produces "beats" which, when they occur at certain frequencies, produce a pleasing effect generally known as "celeste".

Many prior art electronic musical instruments have provided circuitry for varying the pitch of tones in a suitable fashion to produce either celeste or vibrato effects. However, several problems have been encountered in efficiently and inexpensively providing circuitry for producing such effects in conjunction with digital electronic instruments. In such digital electronic instruments the tone generating circuits generally are provided in an all-digital format, wherein a relatively high, radio frequency is generated, and divider circuits having suitable divider ratios are utilized to provide the 12 top tones of the instrument. Thereafter, conventional divide-by-two digital circuits are utilized to provide the corresponding tones in each lower octave of the instrument.

Accordingly, in order to produce a celeste effect in such instruments, it is first necessary to have at least two tone generators assigned to the production of the same note, so that one may be "detuned" or have its pitch varied somewhat relative to the other. However, in digital organs of the type just described, if the celeste-producing circuitry is tuned so as to accomplish a relatively pleasing celeste effect in the lowest octave, for example, one and one-half beats per second, it follows that the number of beats per second produced will double in each succeeding higher octave. A typical instrument has a four or five octave performance range. Consequently, in the fourth and fifth highest octaves of such instruments, conventional celeste circuitry will produce 12 beats per second and 24 beats per second, respectively. Generally speaking, however, a celeste effect in excess of six beats per second is not considered musically pleasing.

Moreover, it has heretofore been the practice to produce celeste effect in such digital instruments by providing two complete sets of master or top octave frequencies and detuning one set from the other. Accordingly, with the ensuing divide-by-two ratios of lower octaves, a choice must be made between producing a suitable celeste effect (six beats per second or less) only in the higher octaves while producing no effect whatsoever in the lower octaves, or conversely, producing a suitable celeste effect in the lower octaves only.

However, novel digital integrated circuit tone generator components are shown and described in the co-pending applications of Schwartz et al, Ser. No. 917,313, now U.S. Pat. No. 4,203,337 and Schwartz et al, Ser. No. 917,314, now U.S. Pat. No. 4,256,002 both filed June 20, 1978. Utilizing these novel components, we have now discovered a method and circuitry for producing satisfactory celeste effect in all octaves of a digital electronic musical instrument. Additionally, in our co-pending application, Ser. No. 917,296, now U.S. Pat. No. 4,196,651 filed June 20, 1978, we disclose novel detuning circuitry incorporated into the integrated circuit components shown and described in the foregoing Schwartz et al applications, for providing non-redundant generator unlocking. Briefly, and as more fully explained in our aforesaid co-pending application, these circuits comprising novel "pulse dropping" circuitry on each generator chip or integrated circuit component, for providing detuning of the nominal frequencies produced by the tone generator circuits located on that chip or integrated circuit component. This "pulse-dropping" circuitry is specifically designed for solving the problem of "locking" of frequencies in situations where two or more generators located on different chips or integrated circuit components are assigned to the production of the same tones or of harmonics of the same fundamental frequencies. Utilizing these same novel features, together with additional novel external circuitry disclosed herein, we have now discovered how to provide suitable celeste effects and vibrato effects across the entire range of performance in instruments utilizing these novel tone generator chips or integrated circuit components.

OBJECTS AND SUMMARY OF THE INVENTION

Accordingly, it is an object of the present invention to provide a novel and improved pitch variation control system for use with an electronic musical instrument, for producing such pitch variation musical effects as celeste and vibrato.

A more specific object of the invention is to provide such a novel and improved pitch variation control system which is effective to produce musically pleasing pitch variation effects such as celeste and vibrato across the entire performance range of the electronic musical instrument.

A related object is to provide a novel and improved pitch variation system of the foregoing type which is relatively simple and inexpensive in its design and manufacture, utilizing but a few relatively inexpensive and readily available components and yet is highly effective and reliable in operation.

Briefly, and in accordance with the foregoing objects, a detuning control system is provided for use with an electronic musical instrument including a plurality of integrated circuit tone generator chips each including at least one tone generator and detuning circuit means responsive to a predetermined detuning control signal for detuning the tones produced thereby. This detuning control system produces an audible pitch variation in the tones produced by said at least one tone generator, to produce a selected musical effect and comprises detuning control circuit means for producing a predetermined detuning control signal and for applying said predetermined detuning control signal to said detuning circuit means of said at least one tone generator to cause relative detuning of the nominal frequency of the tone produced thereby, so as to produce a musically pleasing pitch variation effect.

BRIEF DESCRIPTION OF THE DRAWINGS

Other objects, features and advantages of the invention will become more readily appreciated upon consideration of the following detailed description of the illustrated embodiment, together with the accompanying drawings, wherein.

DETAILED DESCRIPTION OF THE ILLUSTRATED EMBODIMENT

Figure 1:
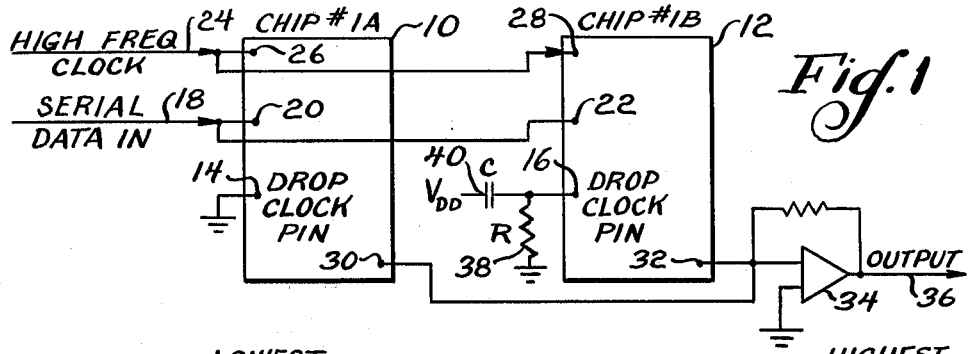
FIG. 1 illustrates a tone generator for an electronic musical instrument in simplified form, provided with novel structure according to the present invention.

Referring initially to FIG. 1, an exemplary tone generation system for an electronic musical instrument is illustrated in block form as comprising a pair of tone generator integrated circuit chips 10 and 12. In its most basic form, a relatively small instrument may be provided with but two of these integrated circuit tone generation chips 10 and 12, here designated as CHIP #1A and as CHIP #1B. Each of these integrated circuit chips carries at least one digital tone generating circuit thereon (not shown). The structure and operation of the tone generation circuitry of the chips 10 and 12 is substantially as shown and described in the copending applications of Schwartz et al, Ser. Nos. 917,313 and 917,314, now respectively U.S. Pat. Nos. 4,203,337 and 4,256,002, both filed on June 20, 1978, which are incorporated herein by reference. Additionally, each of these tone generator chips 10 and 12 is provided with a digital detuning circuit which receives a controlled input at a drop-clock pin 14, 16, respectively. The structure and operation of this detuning circuitry is substantially as shown in our co-pending application number 917,296, filed June 20, 1978, now U.S. Pat. No. 4,196,651 which is incorporated herein by reference.

Briefly, the detuning circuits are responsive to suitable control input signals on the pins 14, 16 for detuning the tones produced by the associated tone generator circuits of the chips 10 and 12 in a predetermined fashion, depending upon the type of signal provided at the respective control inputs 14, 16. In the illustrated embodiment, both of the chips 10 and 12 are assigned to production of the same note or range of notes.

In operation, each of these chips 10 and 12 is responsive to an input signal identifying the tone to be generated, received on a serial data line 18 at respective input pins 20, 22. A high frequency clock signal on a line 24 is also fed to input pins 26, 28 of the respective tone generator chips 10, 12. This high frequency clock signal is preferably on the order of four megahertz and provides a master signal from which the audio tones to be generated by the chips 10, 12 are derived. In this regard, the tone generator circuitry on the chips 10 and 12 is responsive to the serial data in 18 for identifying the note or tone to be derived from this high frequency clock signal 24. The structure of these chips 10, 12 and operation thereof for accomplishing generation of the desired tones in the foregoing fashion are more fully described in the above-referenced Schwartz et al applications.

The tone signals generated by the chips 10 and 12 are output on respective pins 30, 32 and are fed out in common to be mixed in an amplifier 34 to a tone signal output on an output line 36.

In accordance with one aspect of the present invention, a celeste effect is produced at the output line 36 by providing suitable detuning control signals at pins 14 and 16 of the tone generator chips 10 and 12. The detuning control signals are generated and applied so as to result in a relative detuning between the nominally equal frequency tone signals otherwise generated by the chips 10, 12. The amount of detuning is chosen so as to provide a musically pleasing beat frequency of on the order of between one and five beats per second, at which rate a musically pleasing celeste effect is produced.

In accordance with the simplest form of the invention as illustrated in FIG. 1, this relative detuning is accomplished by coupling the drop-clock pin 16 of the chip 12 with the junction between a selected resistor 38 and a selected capacitor 40, which are joined in series between a positive reference potential $V_{DD}$ and ground. At the same time the drop-clock pin 14 of the chip 10 is coupled with ground. Accordingly, an amount of detuning depending upon the values selected for the resistor 38 and the capacitor 40 and of the value of the voltage $V_{DD}$, is experienced in the tones generated by the chip 12, while the tones generated by the chip 10 experience no detuning. Consequently, there is relative detuning between the nominally equal frequency tone signals generated by the chips 10 and 12 so as to produce the desired celeste effect therebetween when the respective tone signals are mixed in amplifier 34 and fed to the output 36. The structure and function of the detuning circuitry of the tone generator chip 12 which accomplishes this detuning in response to the external control circuit comprising voltage $V_{DD}$, resistor 38 and capacitor 40 will be discussed hereinbelow and is also set forth in our U.S. Pat. No. 4,196,651, referenced above.

Figure 2:
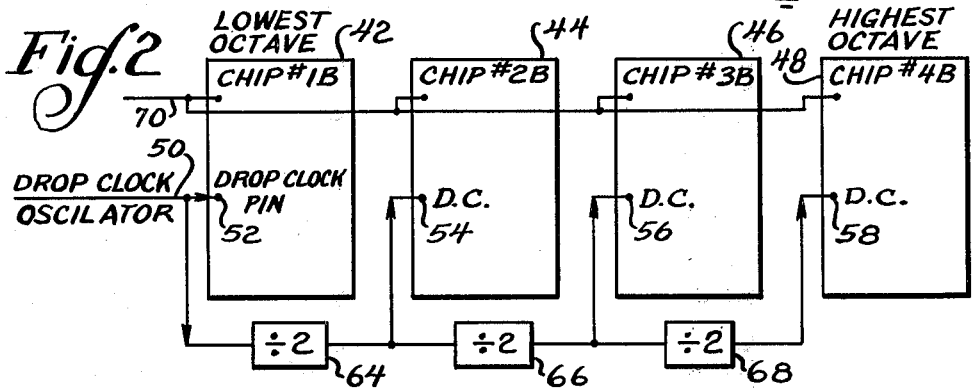
FIG. 2 illustrates a portion of a tone generator for an electronic musical instrument having a four-octave range and provided with another form of the invention.

Reference is next invited to FIG. 2 which illustrates a typical arrangement of integrated circuit tone generator chips for an instrument having a four-octave range. These chips are denominated CHIP #1B, CHIP #2B, CHIP #3B, and #4B, and designated respectively by the reference numerals 42, 44, 46 and 48. In accordance with one practical and preferred form of the invention, these chips 42, 44, 46 and 48 are of the type shown and described in the aforementioned Schwartz et al, U.S. Pat. No. 4,256,002. As described in that co-pending application, these chips 42, 44, 46 and 48 each carry assignment circuitry to accomplish assignment of the tone generator or generators carried by each chip to production of tones only in a single octave of the instrument. Accordingly, the chip 42 is assigned to production of the notes in the lowest octave of the instrument, while the chips 44, 46 and 48 are assigned respectively to production of notes or tones in successively higher octaves. Also provided, but not illustrated in FIG. 2, are an additional four substantially identical integrated circuit tone generator chips, similar to the CHIP 1A of FIG. 1, which are respectively assigned to production of notes or tones of the same octaves as each of the chips 42, 44, 46 and 48.

In accordance with an alternate embodiment of the invention described above with reference to FIG. 1, a drop-clock oscillator 50 provides a signal to the drop-clock pin 52 of the first integrated circuit chip 42. The frequency of this drop-clock oscillator 50 is selected to provide a suitable control input signal to the detuning circuit of the chip 42 so as to provide a predetermined amount of detuning of the frequencies of tones produced thereby with respect to the corresponding CHIP 1A (not shown in FIG. 2) assigned to production of the same notes or tones. Accordingly, the frequency of this drop-clock oscillator is selected so as to produce between one to five beats per second between the output frequencies of the tone signals produced by the chip 42 and its co-assigned chip.

In order to preserve the same relative detuning in each of the higher octaves, this drop-clock oscillator control frequency is divided by two prior to being introduced on control pins 54, 56 and 58 of each, next higher octave. Consequently, divide-by-two circuits 64, 66 and 68 are provided in series circuit, the divide-by-two circuit 64 being interposed between the drop-clock oscillator 50 and the drop-clock input 54 of the next tone generator 44. In similar fashion, the second divide-by-two circuit 66 is interposed between the output of first divide-by-two circuit 64 and the drop-clock input 56 of the tone generator chip 46 assigned to the next higher octave. Similarly, the third divide-by-two circuit 68 is interposed between the second divide-by-two circuit 66 and the drop-clock input 58 of the chip 48 which is assigned to production of notes or tones in the highest octave. In accordance with one practical and preferred form of the invention, the frequency of the drop-clock oscillator 50 may be substantially on the order of 40 KHz, whereby the control frequencies fed to the respective succeeding drop-clock pins 54, 56 and 58 are substantially on the order of 20 KHz, 10 KHz, and 5 KHz, respectively.

As more fully described in our U.S. Pat. No. 4,196,651 referred to hereinabove, the internal detuning circuits of these chips 42, 44, 46 and 48 are also provided with a suitable input control signal on a line 70 for deactivating or disabling internal divider circuits. These internal circuits, if activated, would derive a different, divided detuning or drop-clock signal from the drop-clock oscillator 50 for selected ones of the multiple tone generator circuits located on each tone generator chip. Accordingly, each tone generator located on each of these chips 42, 44, 46 and 48 receives the same detuning control signal produced by the detuning circuitry thereof in response to the control signal fed to its corresponding respective drop-clock pin 52, 54, 56 and 58.

Figure 3:
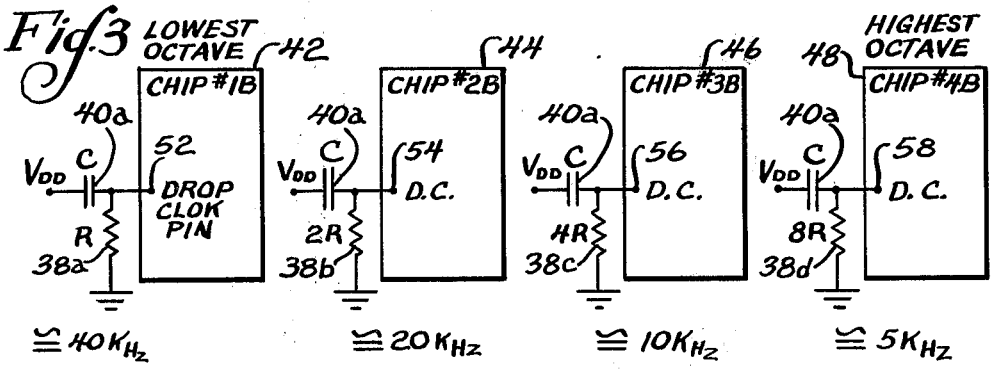
FIG. 3 illustrates a portion of a tone generator for an instrument of four-octave range, similar to FIG. 2, and provided with novel structure according to the invention corresponding to the embodiment of FIG. 1.

Referring to FIG. 3, the multiple-octave tone generator system of FIG. 2 may alternatively be provided with detuning control input signals of the form illustrated with respect to the chip 12 in FIG. 1. Each of the tone generator chips 42, 44, 46 and 48, as illustrated in FIG. 3, is provided with a similar capacitor **40*a* of a selected value C in series between the selected reference voltage $V_{DD}$, and respective ones of selected resistors 38*a*, 38*b*, 38*c* and 38*d*. In order to accomplish the same relation as discussed above with reference to FIG. 2 between the control signals at the respective drop-clock pins 52, 54, 56 and 58 for the successively higher octaves, the resistors 38*a*, 38*b*, 38*c* and 38*d*** are chosen with relative values of R, 2R, 4R and 8R, respectively.

Similar to the embodiment illustrated and described above with reference to FIG. 2, the values R, C of resistor **38*a* and capacitor 40*a* associated with the chip 42 are chosen so as to achieve an internally derived drop-clock or detuning frequency of substantially on the order of 40 KHz. Similarly, the values of resistors 38*b*, 38*c* and 38*d*** in the ratio of 2R, 4R and 8R, respectively are such as to provide internally derived drop-clock or detuning control frequencies of substantially on the order of 20 KHz, 10 KHz and 5 KHz, respectively.

In operation, the novel detuning control arrangements illustrated in FIG. 2 and FIG. 3 achieve a desired degree of detuning of each of the tone generators included in the integrated circuit tone generator chips 42, 44, 46 and 48. Consequently, a musically pleasing celeste effect of from one to five beats per second is obtained when the output signals or tones of these chips are mixed with the "in tune" output signals or tones produced by their co-assigned chips, such as the chip 10 or 1A of FIG. 1, which have their detuning control inputs tied to ground, so as to remain inactive.

Figure 4:
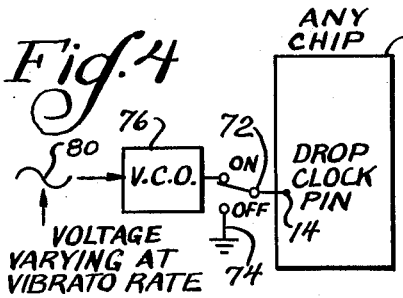
FIG. 4 illustrates, in simplified form, a tone generator provided with a circuitry in accordance with a further aspect of the invention.

Referring now to FIG. 4, and in accordance with a further aspect of the invention, a vibrato effect is also achievable by providing a selected detuning control signal to the drop-clock 10 of any integrated circuit tone generator chip of the type illustrated and described above with reference to FIGS. 1 through 3, inclusive. For purposes of description, the integrated circuit chip 10 of FIG. 1 is again illustrated in FIG. 4, but now receiving a different detuning control signal at its drop-clock pin 14.

In accordance with this further aspect of the invention, the detuning control signal introduced at the pin 14 causes production of a selectable vibrato effect in conjunction with the tone signals produced by the tone generator chip 10. A switch 72 is provided at the pin 14 for alternatively selecting a ground reference potential 74, which produces no detuning or alteration of the tone signals produced by the tone generator chip 10 or alternatively a vibrato control signal provided at the output of a voltage controlled oscillator (VCO) 76. This voltage controlled oscillator 76 produces an output signal of variable frequency in response to a varying voltage signal 80 at its input. When the switch 72 is placed into contact with the output of the VCO 76, the tone signal output from the chip 10 is periodically detuned in accordance with the periodic variations in the frequency of the output signal from the VCO 76. Accordingly, a vibrato effect is imparted to the tone signal output of the tone generator chip 10.

The vibrato rate or rate of the periodic detuning imparting the vibrato effect to this tone signal output is the same rate as the rate of frequency variations in the output of the VCO 76. This rate is the same as the rate of change or variation of the varying voltage 80 at the input thereof. The depth of vibrato imparted to the tone signal output of the tone generator chip 10 is in turn determined by the amount of frequency variation experienced in the output signal of the VCO 76, which in turn is determined by the magnitude of variation in the varying voltage signal 80 applied thereto. In accordance with one practical and preferred form of the invention, the VCO 76 and varying voltage signal 80 applied thereto are selected to produce a frequency variation at the output of VCO 76 of from on the order of 10 KHz to between on the order of 40 KHz and on the order of 200 KHz. Further in accordance with a preferred form of the invention the rate of variation of the voltage signal 80 and hence the resultant vibrato rate is on the order of 6 Hz.

Figure 5:
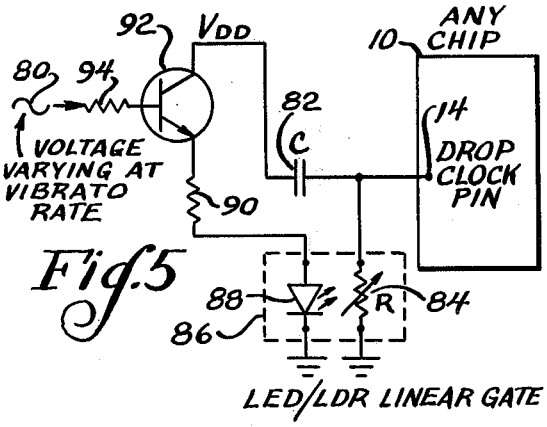
FIG. 5 illustrates a simplified tone generator, similar to FIG. 4, together with a further embodiment of circuitry according to the invention.

Referring now to FIG. 5, an alternative embodiment of the vibrato-producing detuning control circuit of FIG. 4 is illustrated. As with the circuit of FIG. 4 any or all of the integrated circuit chips of the type described above with reference to FIG. 1 through FIG. 3 may be provided with the same vibrato detuning control signal at the drop-clock pin thereof. For purposes of description, however, the tone generator chip 10 and drop-clock pin 14 thereof are again illustrated in FIG. 5.

The vibrato detuning control circuit in FIG. 5 is similar in its structure and theory of operation to the celeste tuning control circuits shown in FIG. 3. In this regard, a fixed capacitor 82 and a variable resistor 84 are joined in series circuit between a positive reference potential and a ground reference potential, the junction between the capacitor 82 and variable resistor 84 being coupled to the drop-clock pin 14. In accordance with the invention, the variable resistor 84 may have its value varied by any suitable means to achieve a periodic detuning control signal at the drop-clock pin 14 which will impart the desired vibrato effect to the tone signal output of the tone generator chip 10. In accordance with one practical and preferred form of the embodiment, the variation of the resistor 84 is between a nominal value R and a value of on the order of 8R and 16R, at a rate of substantially 6 Hz.

In accordance with a preferred form of the invention and as illustrated in FIG. 5, the variable resistor 84 is a light dependent resistor (LDR) which forms one part of an LED/LDR linear gate circuit 86. An LED 88 forms the remainder of the LED/LDR linear gate circuit 86. The cathode electrode of this LED 88 is coupled with ground while the anode electrode thereof is coupled by way of a resistor 90 to the emitter electrode of an NPN transistor 92. The collector electrode of the transistor 92 is coupled to the positive voltage supply $V_{DD}$ while the base electrode thereof receives the voltage 80 varying at the vibrato rate, as described above with reference to FIG. 4, through a series-connected resistor 94. Accordingly, a predetermined current variation will be experienced at the emitter electrode of the transistor 92 in accordance with variations of the voltage signal 80. This will cause a corresponding periodic variation in the energizing current fed to the LED 88 and hence in the resistance value of the LDR 84. In accordance with one practical and preferred form of the invention, the LED/LDR linear gate and the transistor 92 as well as the values of voltage $V_{DD}$, resistors 90, 94 are selected so that the resistance value of LDR 84 varies from substantially between 1½ K Ohms to substantially 8 to 16 times this resistance value.

In accordance with preferred performance practice, it is generally desirable to impart only a celeste effect or only a vibrato effect at any given time to the tones produced by the tone generator chips described above. Moreover, in musical instruments of the variety wherein two chips are assigned to production of nominally the same notes or tones, it is generally considered preferable to provide the celeste effect control circuits of the invention to one of these chips while providing the selectable vibrato control circuits of the invention to the other. For example, of the chips 10 and 12 of FIG. 1, the celeste control circuitry of the invention would be provided with switching means (not shown) so as to be selectively operable only with the chip 12 while the vibrato control circuit of the invention would be selectively applicable by means of a suitable switch (not shown) only to the chip 10. Preferably, the switches for selecting the vibrato or celeste effects would be provided in a mutually exclusive form to permit the selection of only one of these effects at any given time.

Figure 6:
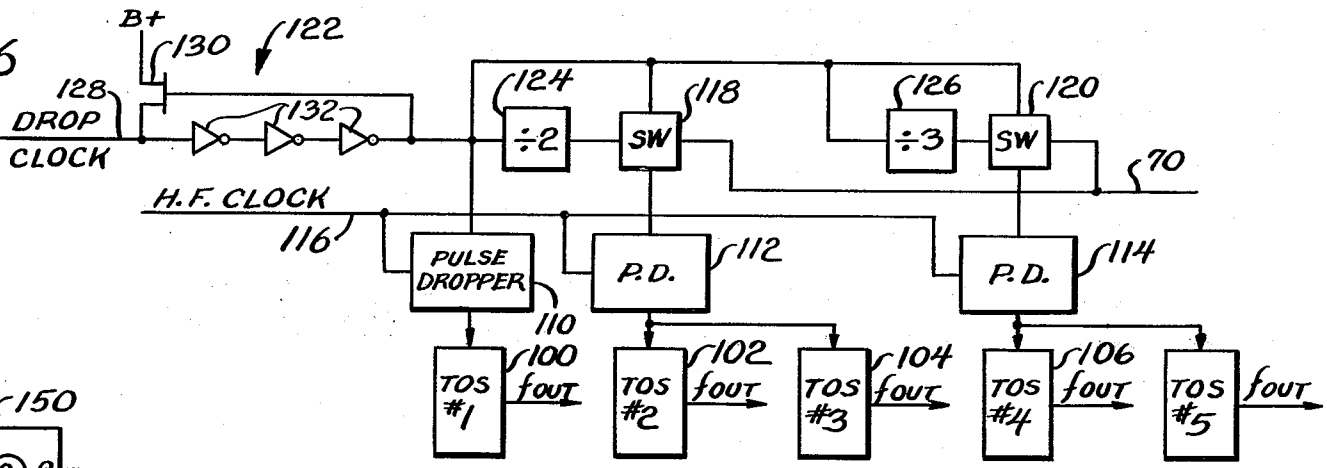
FIG. 6 is a circuit diagram in block form of a portion of a typical tone generator integrated circuit chip, with which the novel circuitry of the invention is intended to cooperate.
Figure 7:
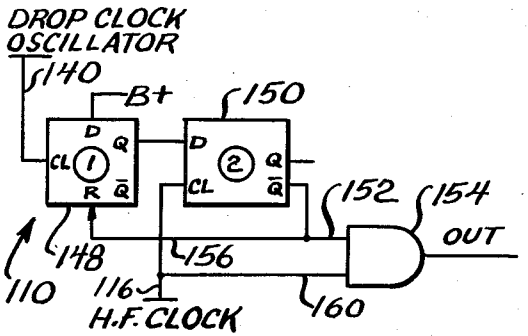
FIG. 7 is a detailed circuit diagram of a portion of the circuit shown in block form in FIG. 6.
Figure 8:
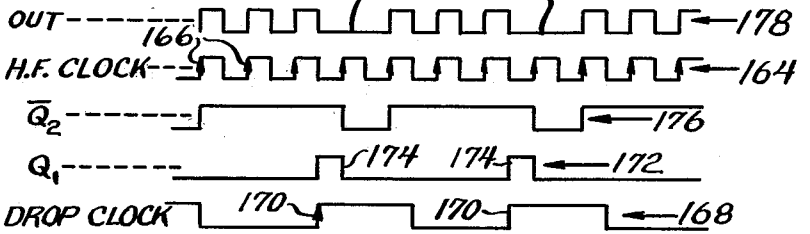
FIG. 8 is a waveform diagram illustrating the operation of the circuit of FIG. 7.

Referring now to FIGS. 6 through 8, and for purposes of a more complete understanding of the operation of the present invention, the detuning control circuit of a tone generator chip, such as chips 10 and 12 of FIG. 1 and chips 42, 44, 46 and 48 of FIGS. 2 and 3, is illustrated in greater detail. As noted above, this circuitry and its operation is substantially as shown and described in our co-pending application Ser. No. 917,296.

Referring initially to FIG. 6, and in accordance with a preferred form of the invention, each of the foregoing integrated circuit tone generator chips is provided with five independent tone generator circuits, each taking the form of a digital top octave synthesizer (TOS) 100, 102, 104, 106 and 108. Each of these top octave synthesizers (TOS) is in turn provided with a master input frequency from which the tones to be generated therefrom are derived. The structure and operation of these top octave synthesizers is substantially as shown and described in the above-referenced Schwartz et al U.S. Pat. Nos. 4,203,337 and 4,256,002.

The master frequency supplied to each TOS is in turn provided by one of three pulse dropper circuit portions 110, 112 or 114. Accordingly, a given variation or detuning of the master frequency signal provided to any TOS 100, 102, 104, 106 or 108 will cause a corresponding relative detuning of the frequencies of notes or tones produced thereby. Each pulse dropper circuit portion 110, 112 and 114 is provided with two signal sources or inputs, the first coming from a high frequency clock or master generator 116. The remaining inputs to pulse dropping circuits 112 and 114 are respectively provided from electronic switching circuit components 118, 120, while the remaining input to the pulse dropper circuit 110 is provided from the output of a drop clock oscillator circuit indicated generally by the reference numeral 122. The switching circuits 118 and 120 are each controllable by the control line 70, mentioned above, for delivering the output of the drop clock oscillator 122 or alternatively for effectively inserting a selected divider circuit 124, 126 in series with this drop clock oscillator 122.

Briefly, in normal operation it is generally preferable to insert a divide-by-two circuit 124 and a divide-by-three circuit 126 in series between the drop clock oscillator and the respective pulse dropping circuits 112 and 114. However, when the celeste detuning control circuit and/or vibrato detuning control circuit of the present invention are utilized, it is preferable to apply a suitable control signal to the line 70 for effectively bypassing these divider circuits 124 and 126.

Referring briefly to the drop clock oscillator circuit 122, a drop clock control signal is applied thereto on an input line 128 which is fed from the drop clock pin of the associated tone generator chip. Hence, in the present invention either the vibrato detuning control signal or celeste detuning control signal is applied at this point of the circuit. The drop clock oscillator 122 comprises an FET gate 130 realized in integrated circuit form and a series of three inverter circuits 132 joined in series to form a delay line between the gate and drain electrodes of the FET 130. The remaining, source electrode of the FET 130 is coupled to a positive voltage supply. The gate electrode of the FET 130 forms the output of the drop clock oscillator.

Reference is next invited to FIGS. 7 and 8 wherein a typical pulse dropper circuit and the operation thereof are illustrated. Each of the pulse dropper circuits 110, 112 and 114 is substantially identical, whereby the pulse dropper circuit 110 is illustrated in FIG. 7. The drop-clock oscillator 122 feeds a first clocking input 140 of a D-type flip-flop 148. The D input of this flip-flop 148 receives a suitable positive voltage B+, while the Q output thereof feeds the D input of a second D-type flip-flop 150. The Q output of the flip-flop 148 is not utilized.

The Q output of the flip-flop 150 is also not utilized, however, the $\overline{Q}$ output thereof is coupled to a first input 152 of a two-input AND gate 154 and to the reset input R of the flip-flop 148 by a line 156. The remaining input 160 of the AND gate 154 is fed from the high frequency clock line 116, which also feeds the clock input CL of the flip-flop 150. The output of the AND gate 154 forms the input to the associated top octave synthesizer (TOS).

Referring now to FIG. 8, a set of pulse waveform diagrams illustrate the operation of the circuit of FIG. 7. The high frequency clock pulses are represented by a pulse train 164, the positive-going portions thereof being indicated by the reference numeral 166. Similarly, the drop-clock input waveform is illustrated as a pulse train 168, having positive going leading edge portions 170. As a particular example to which no limitation is intended, the high frequency clock pulses comprise a 50% duty cycle rectangular waveform of a frequency of on the order of 4 MHz, while the frequency of the drop-clock, which is also a 50% duty cycle rectangular waveform, may be on the order of 5 KHz. The resultant waveform at the Q output of the flip-flop 148 is designated generally by the reference numeral 172, while the resultant waveform at the $\overline{Q}$ output of the flip-flop 150 is designated generally by the reference numeral 176.

Briefly, the waveform 172 comprises a positive rectangular pulse 174 which is triggered in response to each positive-going portion 170 of the drop-clock waveform 168. The waveform 176 is normally a positive pulse but upon being clocked by the positive pulse 174 goes to a logic "0" level upon the next succeeding positive transition 166 of the high frequency clock 164. This negative-going edge of the waveform 176 causes the positive pulse 174 of the waveform 172 to return to the logic "0" level. The waveform 176 goes back high or to the logic "1" level at the next succeeding positive-going edge 166 of the high frequency clock pulse train 164.

Consequently, the AND gate 154, which is driven by the high frequency clock waveform 164 and by the $\overline{Q}$ waveform 176, produces the output waveform (OUT) designated generally by the reference numeral 178. This waveform generally follows the high frequency clock waveform 164 as long as the Q waveform 176 is in the high or logic "1" state. However, when the waveform 176 is in the low or logic "0" state, the output waveform 178 goes to the logic "0" or low state also, not following the succeeding positive-going transitions 166 of the high frequency clock pulses 164. Accordingly, as viewed in FIG. 8, the waveform 178 is substantially the same as the high frequency clock pulse train 164 but with a number of pulses effectively "dropped" therefrom each time the waveform 176 is in the logic "0" state. (The waveform 176 in turn goes to the logic "0" state in response to each positive pulse of the drop-clock waveform 168.)

Accordingly, depending upon the choices of frequencies of the drop-clock and high frequency clock, a varying number of pulses per unit time may be "dropped" from the high frequency clock signal. In the illustrated embodiment, one pulse is dropped from the high frequency clock signal for each drop clock pulse. Consequently, it will be seen that a high frequency clock waveform is fed to the associated top octave synthesizer (TOS) which is slightly lower in its effective frequency than the high frequency clock pulse train 164. This in turn results in a slightly detuned output frequency being produced by the associated top octave synthesizer.

While the invention has been illustrated and described herein with reference to specific embodiments, the invention is not limited thereto. For example, the relative detuning between the generators of chips 10 and 12 of FIG. 1 may also be achieved by coupling the input 14 of the chip 10 with a capacitor and a resistor, rather than to ground (not shown) in the same fashion as the input 16 of the chip 12, but of different relative values than those of the capacitor 40 and the resistor 38. With respect to the embodiment of FIG. 2, the same relative detuning between chips 1B, 2B, 3B, 4B and their corresponding "A" chips (not shown) could also be accomplished by coupling these "A" chips to a generator and divider chain in the same fashion as the drop-clock oscillator and dividers 64, 66, 68 coupled with the "B" chips, but providing "drop-clock" signals of a different frequency. In the circuit of FIG. 3, the same effect would be obtained by holding the values of the resistors **38*a*, 38*b*, 38*c* and 38*d* constant, and instead providing capacitors 40*a*** of relative values C, $\frac{1}{2}$C, $\frac{1}{4}$C and $\frac{1}{8}$C, respectively, associated therewith.

In addition to the foregoing examples, other changes, modifications and alternatives may become apparent to those skilled in the art upon reading the foregoing descriptions. Accordingly, the invention includes such changes, modifications and alternatives insofar as they fall within the spirit and scope of the appended claims.

The invention is claimed as follows:

1. In an electronic musical instrument including a plurality of integrated circuit tone generator chips each including tone generator and detuning circuit means responsive to a predetermined detuning control signal for detuning the tones produced by said tone generator and wherein at least one pair of said integrated circuit tone generator chips are commonly assigned for the simultaneous production of the same tones, a celeste system comprising: detuning control circuit means including signal producing means for producing at least one predetermined detuning control signal and signal selection means for selectively applying said at least one predetermined detuning control signal to the detuning circuit means of at least one of said at least one pair of commonly assigned tone generator chips to cause a predetermined amount of detuning of the tones produced thereby with respect to the other of said at least one pair of commonly assigned tone generator chips, the tone signal outputs of said at least one pair of integrated circuit tone generator chips thereby being detuned relative to each other so as to produce a celeste effect, said detuning control circuit signal producing means comprising selected capacitor means and selected resistor means coupled in series circuit between a reference voltage and ground, said signal selection means selectively coupling a junction between said capacitor means and said resistor means with said detuning means of said at least one of said at least one pair of commonly assigned tone generator chips.

2. In an electronic musical instrument according to claim 1 wherein said instrument has a multiple octave range and a plurality of said commonly assigned pairs of integrated circuit tone generator chips, each pair being assigned to the production of tones in a selected octave, said detuning control circuit means comprising one said selected capacitor means and one said selected resistor means for at least one of each of said commonly assigned pairs of integrated circuit tone generator chips, and wherein the ratio of the resistance value of said selected resistor means to the capacitance value of the selected capacitor means associated with the integrated circuit tone generator chip assigned to a given octave is in a ratio of 2:1 with the ratio of the resistance value of the selected resistor means to the capacitance value of the selected capacitor means associated with the integrated circuit tone generator chip assigned to the next lower octave.

3. In an electronic musical instrument including a plurality of integrated circuit tone generator chips each including tone generator and detuning circuit means responsive to a predetermined detuning control signal for detuning the tones produced by said tone generator and wherein at least one pair of said integrated circuit tone generator chips are commonly assigned for the simultaneous production of the same tones, a celeste system comprising: detuning control circuit means including signal producing means for producing at least one predetermined detuning control signal and signal selection means for selectively applying said at least one predetermined detuning control signal to the detuning circuit means of at least one of said at least one pair of commonly assigned tone generator chips to cause a predetermined amount of detuning of the tones produced thereby with respect to the other of said at least one pair of commonly assigned tone generator chips, the tone signal outputs of said at least one pair of integrated circuit tone generator chips thereby being detuned relative to each other so as to produce a celeste effect, said signal producing means comprising oscillator means for delivering a periodic signal of a predetermined frequency to the detuning control circuit means of said at least one integrated circuit tone generator chip, said instrument including a plurality of octaves and wherein said plurality of integrated circuit tone generator chips includes at least one pair of said commonly assigned integrated circuit tone generator chips assigned to the production of tones in each octave of said instrument, said signal producing circuit means including at least one oscillator of given frequency for providing a detuning control signal of a first predetermined frequency to at least one of the pair of commonly assigned integrated circuit tone generator chips assigned to production of tones in the lowest octave of said instrument and a plurality of divide-by-two circuits interconnected in series circuit from said at least one oscillator, the detuning control circuits of at least one of each of the remaining commonly assigned pairs of integrated circuit tone generator chips being fed from selected junctions between said divide-by-two circuits, so that the frequencies applied respectively thereto are successively halved for each successive higher octave.

4. In an electronic musical instrument including at least one integrated circuit tone generator chip including tone generator means and detuning circuit means responsive to a predetermined detuning control signal for detuning the tones produced by said tone generator means, a vibrato system comprising: detuning control circuit means including signalling means for producing said predetermined detuning control signal and signal selecting means for selectively applying said predetermined detuning control signal to said detuning circuit means of said at least one integrated circuit tone generator chip to cause detuning of the tones produced by the tone generator means thereof in a periodically varying fashion so as to produce a vibrato effect, said signalling means comprising capacitor means and resistor means coupled in series circuit between a reference voltage and ground, and said signal selecting means selectably couples a junction between said capacitor and said resistor means to the detuning control circuit of said integrated circuit tone generator chip, and further including rate control means for varying the resistance value of said resistor means over a predetermined range and at a predetermined rate.

5. In an electronic musical instrument according to claim 4 wherein said resistor means comprises an LDR, and said rate control means comprises an LED and means providing a periodically varying signal driving said LED.

6. In an electronic musical instrument according to claim 5 wherein said LED and LDR comprise an LED/LDR linear gate circuit component and wherein said rate control means comprises electronic switching means and means providing a periodic signal at a selectable rate to said electronic switching means.

7. In an electronic musical instrument having a multiple octave range, the combination comprising a plurality of integrated circuit chips each having at least one assignable generator, there being at least one pair of chips assigned to each octave of said instrument and respectively comprising a first chip and a second chip of each pair of chips, each chip having input means for a high frequency clock signal and input means for serial data in, at least the second of each pair of chips having drop clock input means, each chip having means interconnecting said at least one generator, and said clock signal input means and said serial data input means to determine the frequency to which a generator is assigned, each the second of each pair of chips further having drop clock circuit means interconnected with said drop clock input means, said high frequency clock input means, and said at least one tone generator to detune such tone generator from its nominal assigned frequency, said at least one generator of the first of each pair of chips producing its nominal assigned frequency without detuning, and external circuit means connected to said drop clock input means and including means having factors of substantially 2:1 from one octave to the next so that the detuning of the second chip generator in each octave is substantially the same, thereby producing a substantially constant beat between the first and second chip generators in all octaves to produce a celeste effect.

8. The combination set forth in claim 7 wherein said external circuit means comprises for each octave a D.C. voltage having a parameter of voltage, a capacitor having a parameter of capacity, and a resistor having a parameter of resistance, for each octave the capacitor and resistor being arranged in series between said D.C. voltage and ground, and a junction between each resistor and capacitor which is connected to the respective drop clock input, one of said parameters having a factor of substantially 2:1 from one octave to the next.

9. The combination set forth in claim 8 wherein it is the resistance parameter that has a factor of 2:1 from one octave to the next.

10. The combination set forth in claim 7 wherein there is an external drop clock oscillator connected to the drop clock input means of the lowest octave second chip, and said external circuit means comprises a succession of divide-by-two circuits successively connected to successively higher octave drop clock input means.

* * * * *

UNITED STATES PATENT AND TRADEMARK OFFICE

CERTIFICATE OF CORRECTION

PATENT NO. : 4,342,247

DATED : August 3, 1982

INVENTOR(S) : ANTHONY C. IPPOLITO & WILLIAM R. HOSKINSON

It is certified that error appears in the above-identified patent and that said Letters Patent is hereby corrected as shown below:

Column 9, line 24, change "Q" to --$\overline{Q}$--;

Column 10, line 1, change "Q" to --$\overline{Q}$--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*